United States Patent [19]

Mondini

[11] Patent Number: 4,974,392

[45] Date of Patent: Dec. 4, 1990

[54] APPARATUS FOR CLOSING CONTAINERS WITH A SEALING LAMINA

[75] Inventor: Giovanni Mondini, Cologne Bresciano, Italy

[73] Assignee: G. Mondini S.p.A., Cologne Bresciano, Italy

[21] Appl. No.: 326,840

[22] Filed: Mar. 21, 1989

[30] Foreign Application Priority Data

Mar. 24, 1988 [IT] Italy ..... 19934 A/88

[51] Int. Cl.[5] ..... B65B 7/28; B65G 25/00

[52] U.S. Cl. ..... 53/287; 53/306; 53/329; 198/468.1; 198/742

[58] Field of Search ..... 53/287, 329, 373, 281, 53/306, 310; 198/346.2, 468.1, 740, 741, 742

[56] References Cited

U.S. PATENT DOCUMENTS

| | | | |
|---|---|---|---|
| 1,577,627 | 3/1926 | Webster | 198/742 X |
| 2,295,049 | 9/1942 | Pityo | 53/329 X |
| 3,135,395 | 6/1964 | Wallis | 198/740 X |
| 3,345,797 | 10/1967 | Von Stoeser | 53/329 X |
| 3,430,782 | 3/1969 | Henkel | 198/740 X |
| 3,453,167 | 7/1969 | Arvidson et al. | 198/468.1 X |
| 3,507,093 | 4/1970 | Marion | 53/329 X |
| 3,754,667 | 8/1973 | Storch | 198/740 X |
| 3,757,961 | 9/1973 | Jacobs | 198/740 X |
| 3,841,468 | 10/1974 | Eggert | 198/740 X |
| 4,095,390 | 6/1978 | Knudsen | 53/373 X |

*Primary Examiner*—Robert L. Spruill
*Assistant Examiner*—Beth Bianca
*Attorney, Agent, or Firm*—Guido Modiano; Albert Josif

[57] ABSTRACT

The apparatus for closing containers with a sealing lamina comprises a framework for supporting a first conveyor belt for feeding containers to be closed, which is connected to a heat-welding unit and to a second conveyor belt for removing the closed containers. The apparatus has a pusher element which can engage a plurality of containers. First actuation means act on the pusher to move it from a position of engagement of the containers to a position of disengagement therefrom, and second means move it along an axis which is parallel to the direction of advancement of the containers.

21 Claims, 5 Drawing Sheets

1
2
3
4
4a
4b
5
6
8
9
11
12
13
14
15
16
17
18
19
20
21
22
22a
26
28
29
29a
30
30a
31
32
33
36
37
38
39
40
41
42
44
45
48
49
50
IX
IX

APPARATUS FOR CLOSING CONTAINERS WITH A SEALING LAMINA

BACKGROUND OF THE INVENTION

The present invention relates to a device for closing containers with a sealing lamina.

As is known, in order to perform the process of closing by heat-welding, it is necessary to arrange a plurality of containers below the head of a sealing unit; said containers are subsequently compressed against the opposite surface of said head with the interposition of a film of heat-weldable material such as aluminum or plastic.

Said containers have a sharp edge along the periphery of their rim and a planar region which is arranged further inwardly and has a limited width.

Due to the pressure exerted on the containers, the thin lamina of interposed material is cut at the sharp edges and is heat-welded at the planar regions of the rims.

In practice the containers are conveyed by means of a continuous conveyor belt on supporting tables or grids which are arranged manually below the head, from which they are removed with the same manual method.

Even with the use of conveyor belts for feeding and removal, the process does not allow high speeds, since it is discontinuous and not automated.

Another disadvantage resides in the fact that heads of considerable dimensions are used in order to increase the number of containers treated simultaneously, with consequent higher manufacturing and operating costs for the apparatus.

SUMMARY OF THE INVENTION

The aim of the present invention is to eliminate the above described disadvantages by providing an apparatus for closing containers by heat-welding lids obtained from a lamina, which allows continuous-cycle processing.

Within the scope of this aim, a particular object is to completely automate the transfer of the containers among the various parts of the apparatus.

A further object of the invention is to provide an apparatus which has reduced dimensions though it allows high speed in its production cycle.

A not least object of the present invention is to provide an apparatus which is capable of giving the greatest assurances of reliability and safety in use by virtue of its peculiar constructive characteristics.

This aim, as well as these and other objects which will become apparent hereinafter, are achieved by an apparatus for closing containers with a sealing lamina, comprising a framework for supporting a first conveyor belt for feeding containers to be closed operatively connected to a sealing unit comprising a heat-welding head arranged above a resting table and to a second conveyor belt for removing the already-closed containers, characterized in that it comprises a pusher having a grip portion which is engageable with a plurality of containers and is arranged on said framework in a region adjacent to said table and to said belts, first actuation means acting on said pusher to move it from a position of engagement with said plurality of containers to a position of disengagement therefrom, and second actuation means acting on said pusher to move it from a first position, in which said grip portion is arranged partially facing said first belt and said table, to a second longitudinal position, in which said grip portion is arranged partially facing said second belt and said table.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
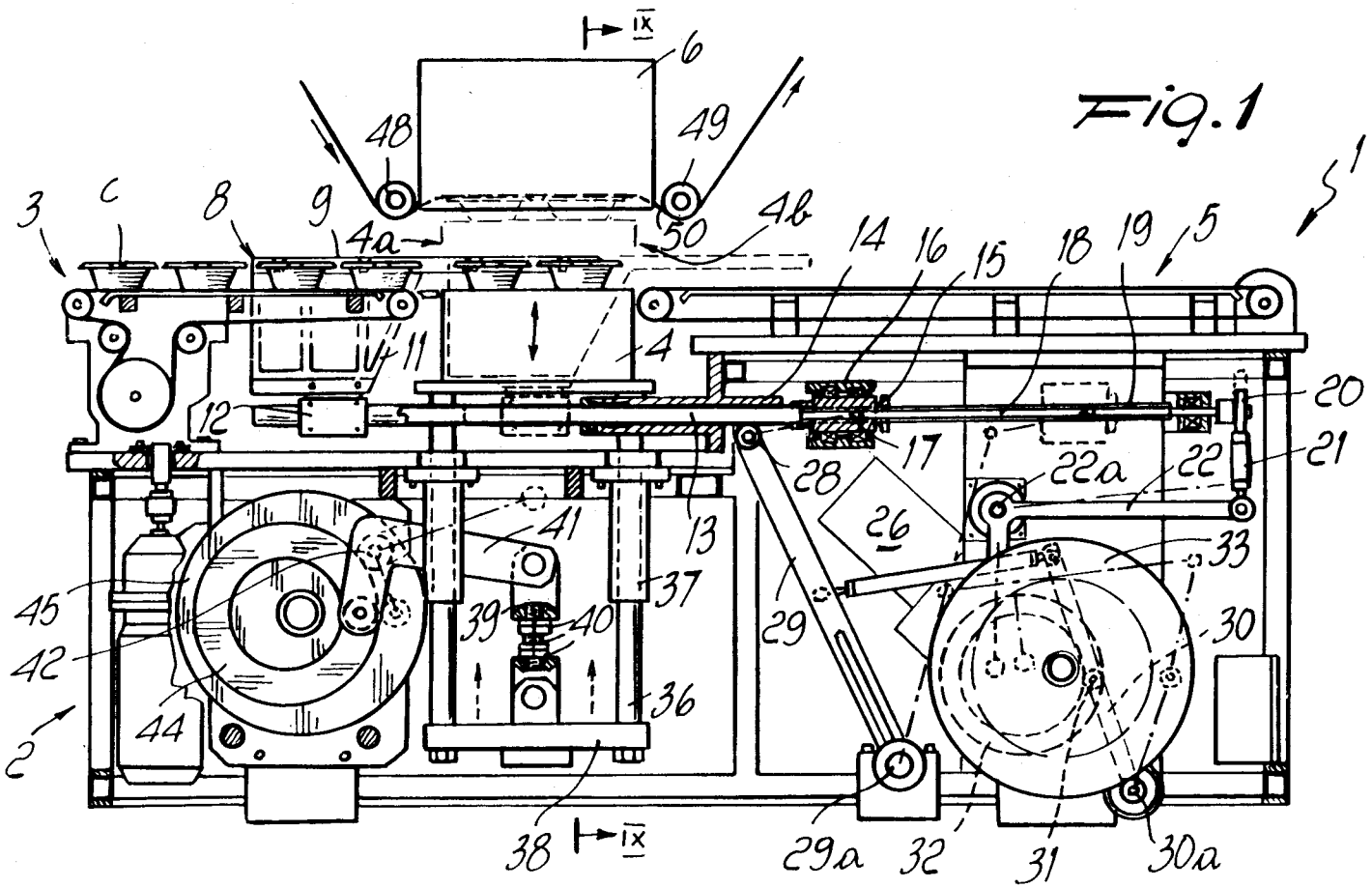
FIG. 1 is a partially sectional lateral elevational view of the apparatus according to the invention, with some parts illustrated schematically.

With reference to the above described figures, the apparatus according to the invention, generally indicated by the reference numeral 1, comprises a framework 2 which supports a first conveyor belt 3 for feeding containers which are to be closed, a heat-welding unit formed by a resting table 4 above which a welding head 6 is arranged and a second conveyor belt 5 for removing the closed containers. The first conveyor belt 3 is arranged at an inlet 4*a* of the heat-welding unit and the second conveyor belt 5 is arranged at an outlet 4*b* of the heat-welding unit. A continuous conveyor line is thereby formed by the heat-welding unit and the two conveyor belts along which the containers are moved.

In particular, the first conveyor belt 3 is of the intermittent type to allow a certain number of containers to wait ahead of the heat-welding unit for the time required to transfer them onto the resting table. A continuous conveyor belt (not illustrated in FIG. 1) may be arranged ahead of said first conveyor belt 3; and its end portion 7 adjacent to the conveyor belt 3 has been schematically illustrated in FIGS. 2 to 4.

It should be furthermore noted that the resting table 4 is initially at the same level as the conveyor belts 3 and 5.

The apparatus according to the invention advantageously comprises a pusher which is arranged laterally on said frame in a region adjacent to the table 4 and to the belts 3 and 5. In the preferred embodiment which is illustrated and described, said pusher comprises a first pusher element and a second pusher element, equal to one another or opposite with respect to the table and to the conveyor belts so as to engage the containers on opposite sides. The pusher 8 is formed by a grip region 9 having protrusions 10 adapted to engage with a plurality of containers C and connected by means of an intermediate portion 11 to a sleeve-like coupling portion 12. The grip portion 9 is conveniently substantially twice as long as the table. In the illustrated case the shape of the protrusions 10 is extremely simple, since it adapts to lateral protrusions provided on the containers. In alternative embodiments, however, a single lateral pusher element with more complicated grip elements, such as brackets, may be provided so as to laterally and rearwardly engage the containers, which may possibly be supported on the opposite side with respect to the pusher by a longitudinal guide.

A shaft 13 is used to actuate in practice the oscillatory and longitudinal translatory movements of the pusher 8; said shaft is mounted freely rotatable and slidable in a support 14 rigidly associated with the framework 2, in such a position that its axis is parallel to the direction of unwinding of the belts 3 and 5. The coupling portion 12 is fixed to one end of the shaft 13 and supports the intermediate portion 11 and the grip portion 9 so that the latter extends in a direction which is parallel to the shaft 13. An end sleeve 15 is fixed to the end of the shaft 13 which is opposite to the coupling portion 12; said sleeve supports a pusher bush 16 which is free to rotate but not to shift with respect to the sleeve 15. Said sleeve is internally provided with a longitudinal groove 17 which extends parallel to the axis of the shaft 13.

Actuation means advantageously act on the pusher to make it oscillate about its axis of rotation from a first engagement position to a second disengagement position relatively to the plurality of containers.

Figure 5:
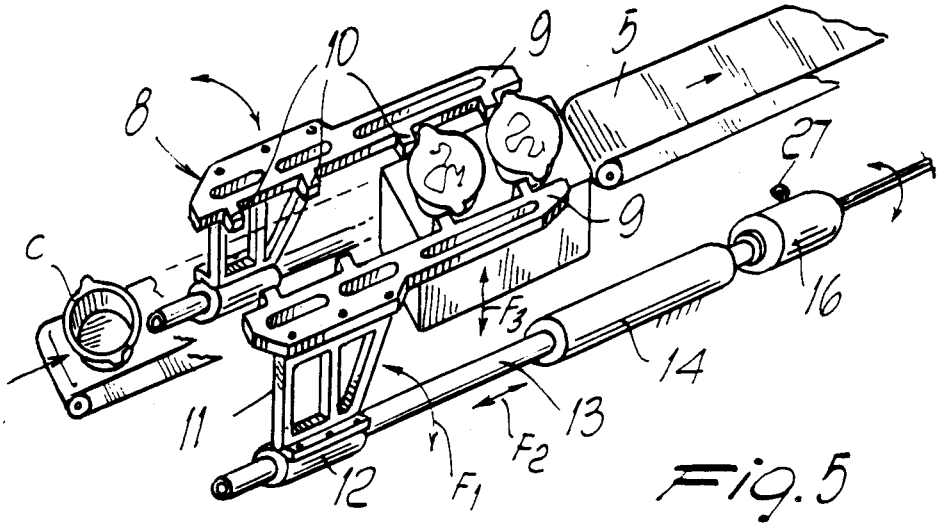
FIG. 5 is a perspective view of a detail of the apparatus, illustrating the pusher element, wherein some parts have been removed for the sake of clarity.
Figure 6:
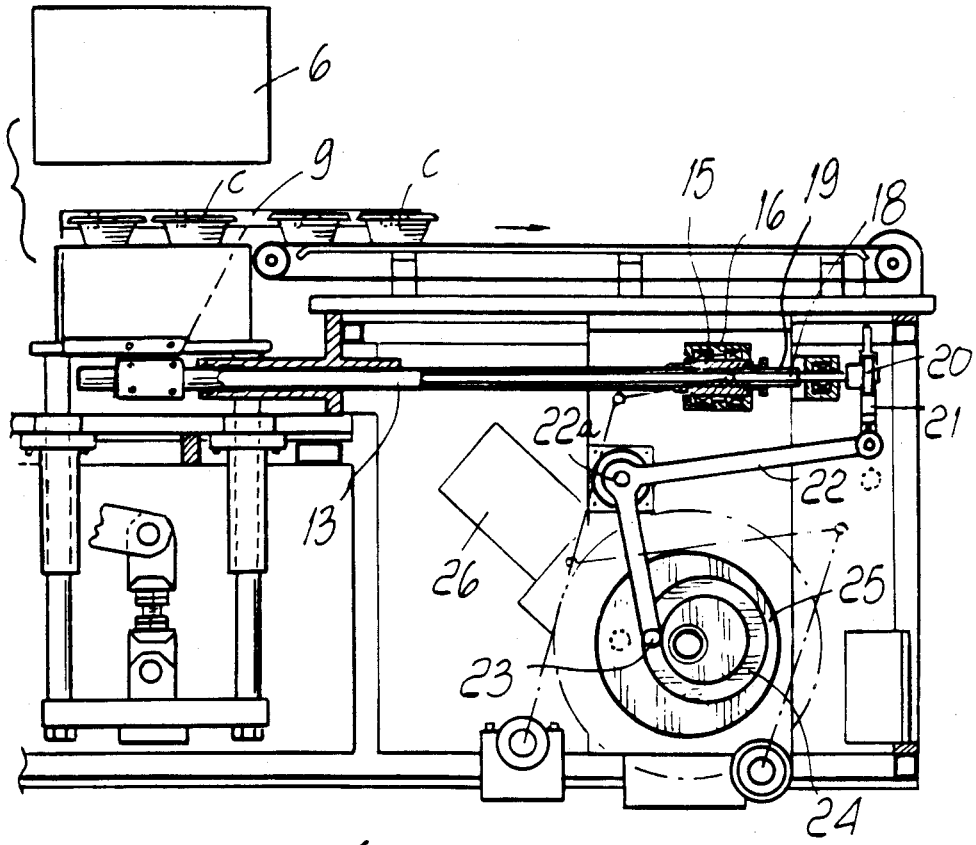
FIG. 6 is a partially sectional lateral elevational view of a part of the apparatus according to the invention.
Figure 8:
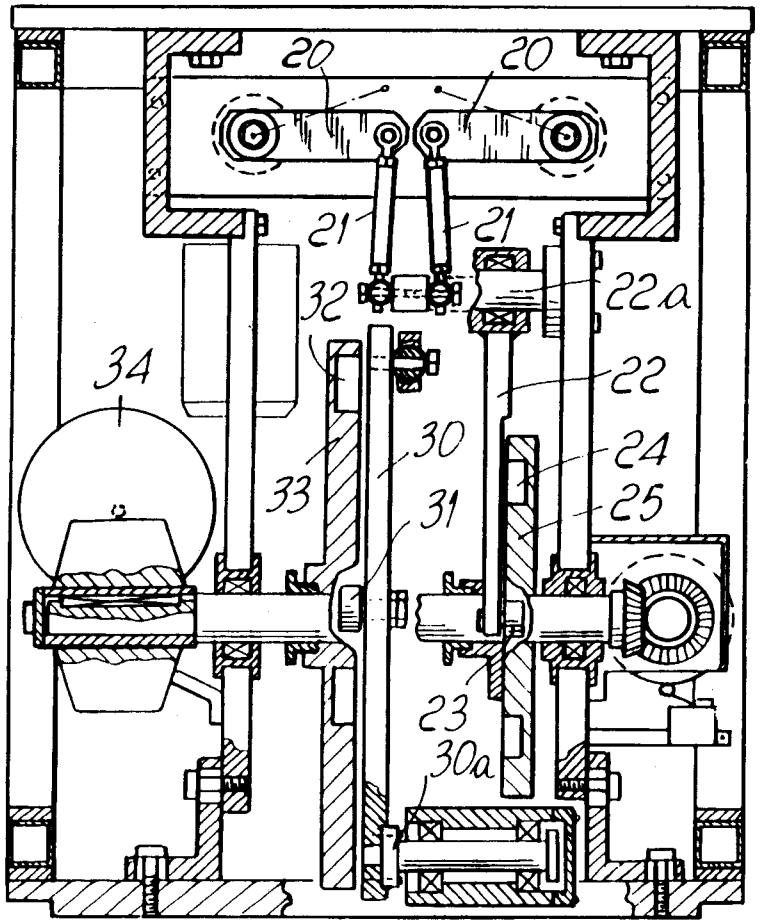
FIG. 8 is a second partially sectional front elevational view of the apparatus according to the invention.

In particular, a torsion shaft 18 is supported coaxially to the actuation shaft 13 and has a longitudinal protrusion 19 engageable with the inner groove 17 of the end sleeve 15. Said shaft 18 is inserted in the sleeve 15 and extends within the shaft 13. In this manner, while the torsion shaft 18 transmits a rotation to the actuation shaft 13, the latter can slide freely along its axis by virtue of the groove provided inside the sleeve 15 as indicated in FIG. 5 by the arrows F1 and F2.

A crank 20 is keyed to the free end of the torsion shaft 18 and is connected by means of a tension element 21 to an L-shaped lever 22 pivoted at 22*a* on the supporting framework 2. A roller 23 is pivoted on the other end of the L-shaped lever 22 and is slidably guided in a circular groove 24 provided on a cam defined beforehand in a wheel 25.

Said wheel 25 and said cam path 24 constitute, as a whole, the first guiding means, and are actuated by a first motor reducer assembly 26.

Second actuation means are advantageously provided and act on the pusher to move it longitudinally along its axis of rotation.

In particular, the pivot 27 fixed to the bush 16 is connected by means of an articulating rod, not illustrated, to the end 28 of a first lever 29 of an articulated quadrilateral; said first lever is pivoted at 29*a*, and a second follower roller 31 is pivoted on the second lever 30 of said articulated quadrilateral; said second lever is pivoted at 30*a*. Said roller 31 is guided within a circular groove 32 defined on a cam provided beforehand in a second actuation wheel 33 which is rotatably mounted on the framework 2 and is actuated by a second motor reducer assembly 34.

According to the invention, the table 4 is mounted on a slider 35 formed by columns 36 which can slide vertically in supports 37 rigidly associated with the supporting framework and are downwardly connected to a plate 38.

Third actuation means conveniently act on the table 4 to move it vertically towards and/or away from the heat-welding head 6, as indicated by the arrow F3. Said third actuation means comprise a hydraulic or pneumatic piston which has the function of automatically adjusting the specific welding pressure, which can be preset for any kind and thickness of sealing lamina. The length of said piston 39 can be adjusted by means of screws and internal or female threads 40; said piston is connected to one end of an L-shaped lever 41 which is pivoted at 42 in the framework and has a follower roller 43 at the other end. Said roller is guided by a guiding groove 44 defined in a third actuation wheel 45 actuated by third motor means 46. The wheel 45 and the groove 44 constitute, as a whole, the third guiding means.

Figure 7:
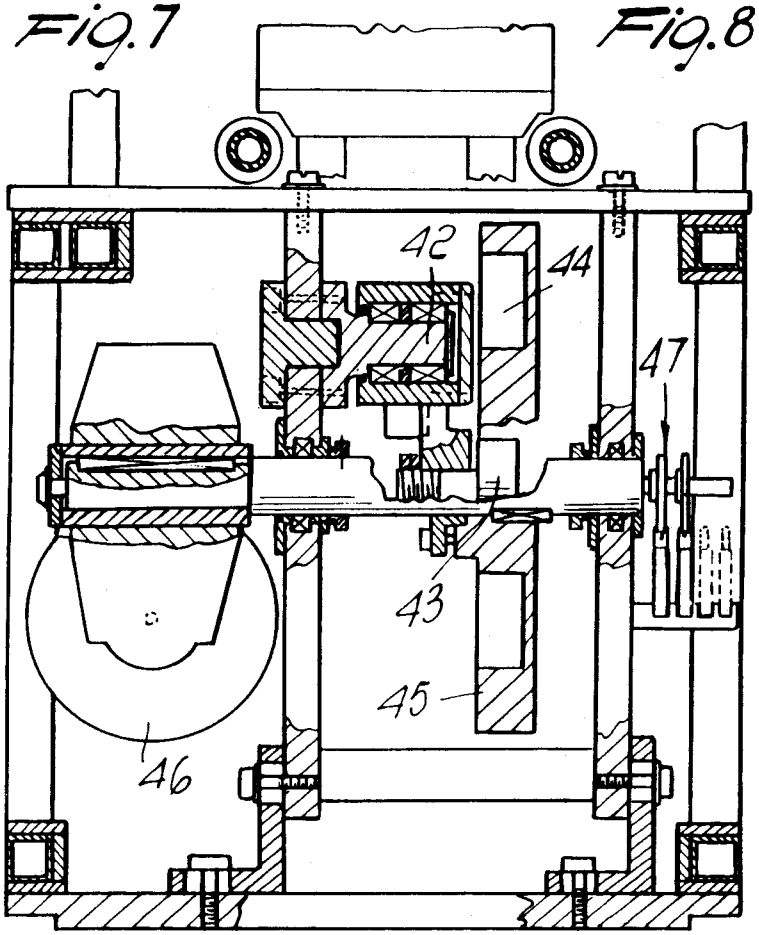
FIG. 7 is a first partially sectional front elevational view of the apparatus according to the invention.
Figure 9:
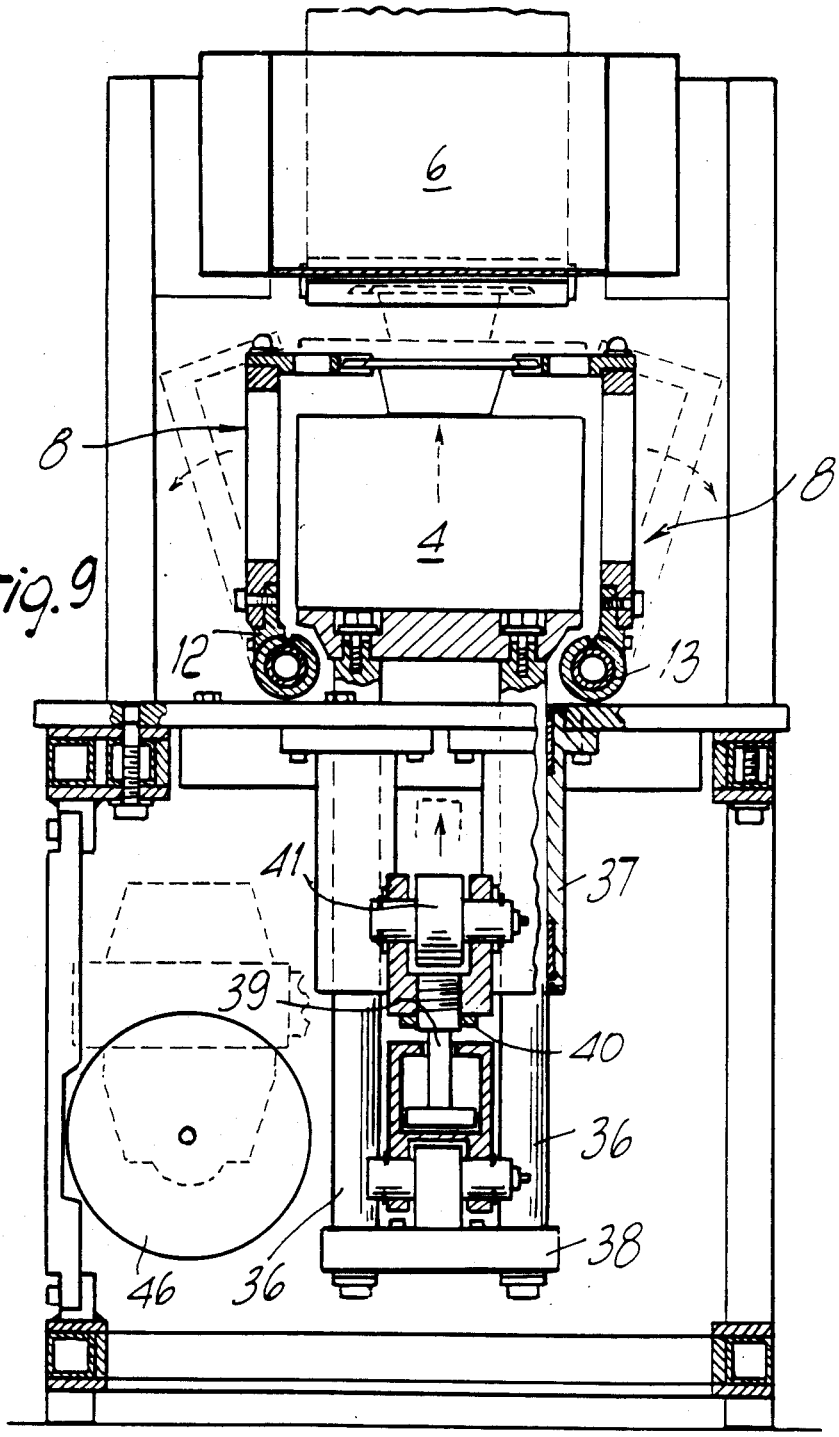
FIG. 9 is a sectional view taken along the line IX—IX of FIG. 1.

Synchronization means are provided in order to mutually synchronize the movements of the three actuation means and are schematically indicated in FIG. 7 by the reference numeral 47; said means substantially consist of cam assemblies associated with electric switches for actuating motor reducer units which respectively actuate the actuation wheels 23, 33 and 45.

For the sake of completeness of the description, two rollers 48 and 49 are provided at the input and at the output of the heat-welding head and support a band of laminar material 50.

Figures 2, 3, 4:
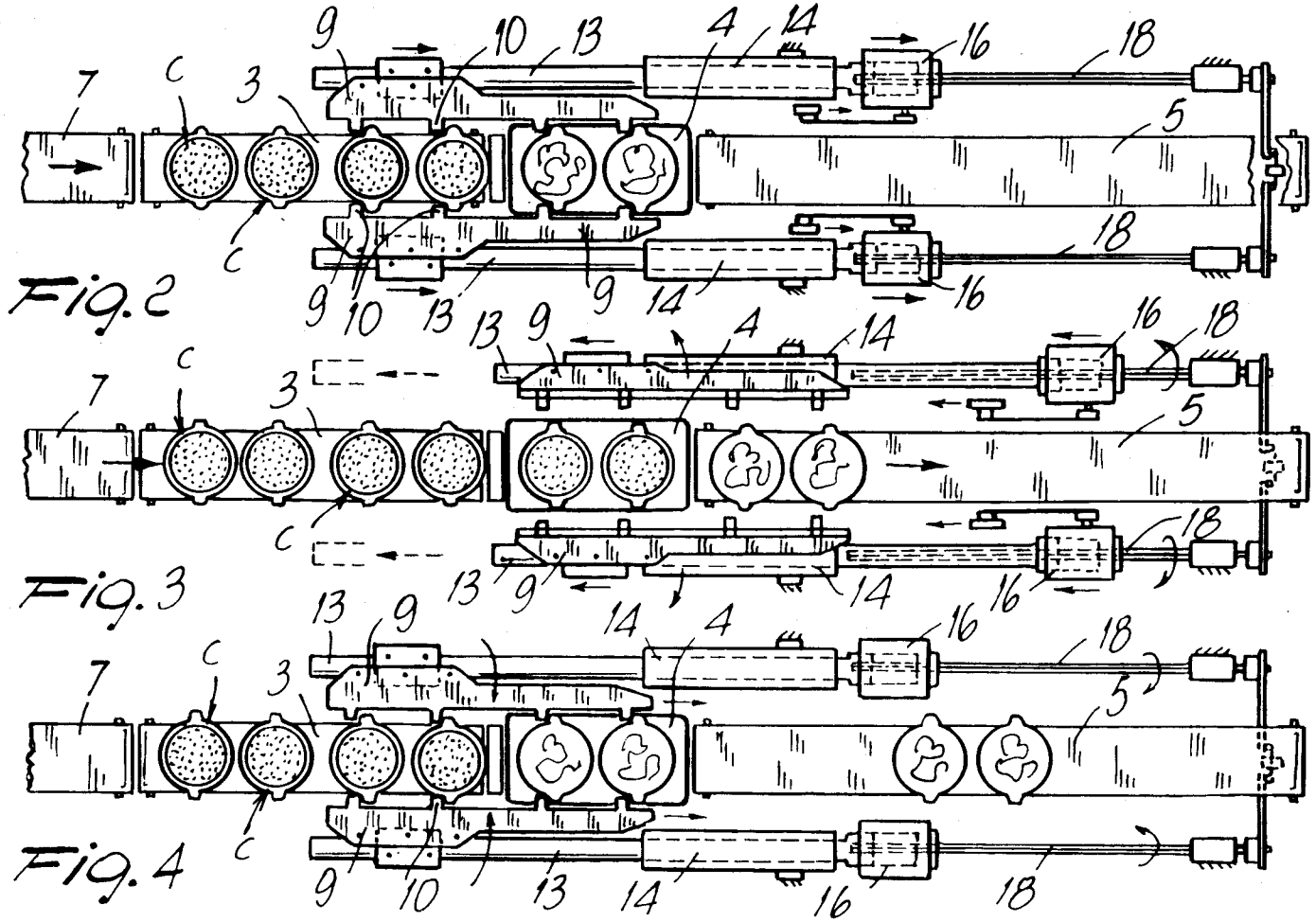
FIGS. 2 to 4 are schematic top plan views of a detail of the apparatus according to the invention in three successive operating steps, wherein the head has been removed for the sake of clarity.

The operation of the pusher element can be understood more clearly with reference to FIGS. 2, 3 and 4.

With reference to FIG. 2, the pusher 8 is shown in top view in a first terminal position in which the grip portions 9 are engaged with the containers, with their leading half arranged facing the table 4 and with their trailing half arranged facing the conveyor belt 3.

The rightward movement of the actuation shafts 13 causes the advancement of the pair of pushers to a second terminal position in which the grip portions 9 have their trailing half arranged facing the table 4 and their leading half arranged facing the conveyor belt 5. This condition is illustrated in FIG. 3, wherein the two pusher elements are disengaged from the containers due to their opposite rotation provided by means of the actuation shafts 13.

The pushers return toward their first terminal position with the grip portions open, i.e. not engaged with the containers, as shown in broken lines in FIG. 3. FIG. 4 illustrates the pushers just before they resume their cycle of transfer from their first longitudinal position, in which the grip portions are engaged with the containers, toward their second longitudinal terminal position.

After what has been described, the operation of the device according to the invention is evident. In order to transfer the containers from the conveyor belt 3 to the resting table 4, the first and second actuation means are synchronized so as to provide movement from the first longitudinal position to the second one while the grip portions are engaged with the containers. During this step the third actuation means are synchronized so as to keep the table 4 at the same level as the conveyor belts 3 and 5. During the return phase from the second position to the first position with the grip portions open, the third actuation means are synchronized so as to cause the table 4 to move towards and subsequently away from the heat-welding head 6. When the table is in its uppermost position the containers resting thereon are pushed against the lamina 50, which is cut and welded onto said containers.

When the pushers are returned to their first terminal position with the grip portions open, the table is at the same level as the conveyor belts 3 and 5 and can thus start a new work cycle.

In practice it has been observed that the apparatus according to the invention fully achieves the aim of automating the process of heat-welding containers and of making it continuous with a high operating speed, while allowing to contain the dimensions of the apparatus in the direction parallel to the extension of the belts.

The apparatus thus conceived is susceptible to numerous modifications and variations, all of which are within the scope of the inventive concept; all the details may furthermore be replaced with technically equivalent elements.

In practice, the materials employed, so long as compatible with the specified use, as well as the dimensions, may be any according to the requirements and to the state of the art.

I claim:

1. Automatic apparatus for closing containers with a sealing lamina, comprising:

a framework, a sealing unit supported by said framework, said sealing unit comprising a heat-welding head and a resting table for containers, said heat-welding head being arranged above said resting table, said sealing unit having an inlet end and an outlet end, a first conveyor belt for feeding containers to be closed, said first conveyor belt being supported by said framework and being operatively connected to said inlet end of said sealing unit, a second conveyor belt for removing closed containers, said second conveyor belt being supported by said framework and being operatively connected to said outlet end of said sealing unit, a conveyor line along which containers travel, said conveyor line being defined by said first conveyor belt, said sealing unit and said second conveyor belt, wherein said apparatus further comprises a pusher for moving a plurality of containers along said conveyor line from said first conveyor belt to said sealing unit and from said sealing unit to said second conveyor belt, said pusher being supported by said framework and being arranged laterally to said conveyor line, a grip portion being defined by said pusher, said grip portion being adapted to grip containers to be moved, said apparatus further comprising first actuation means and second actuation means, said first actuation means acting on said pusher to engage said grip portion with containers and to disengage said grip portion from containers, said second actuation means acting on said pusher to move said pusher between a first position, in which said pusher is arranged laterally to said conveyor line at said inlet end where said first conveyor belt is operatively connected to said sealing unit, and a second position, in which said pusher is arranged laterally to said conveyor line at said outlet end where said second conveyor belt is operatively connected to said sealing unit, wherein said pusher comprises an intermediate connecting portion and a coupling portion, said apparatus further comprising an actuation shaft, a first end being defined by said actuation shaft, a second end being defined by said actuation shaft, said actuation shaft being rotatably and slidably supported on said framework, said actuation shaft being parallel to said conveyor line, said intermediate connecting portion being connected at one end to said grip portion and being connected at another end to said coupling portion, said coupling portion being rigidly fixed to said first end of said actuation shaft.

2. Apparatus according to claim 1, wherein said grip portion extends substantially parallel to said conveyor line, said grip portion has a useful length which is substantially twice that of said resting table, whereby when said pusher is in said first position, said first actuation means act on said pusher to engage said grip portion simultaneously with unsealed containers on said first conveyor belt and with sealed containers on said resting table of said sealing unit, said second actuation means subsequently act on said pusher to move said pusher to said second position, said first actuation means subsequently act on said pusher to disengage said grip portion from containers to simultaneously place sealed containers on said second conveyor belt and unsealed containers on said resting table of said sealing unit.

3. Apparatus according to claim 1, wherein a leading half is defined by said grip portion, a trailing half is defined by said grip portion, said leading half of said grip portion is arranged laterally to said resting table when said pusher is in said first position, said trailing half of said grip portion is arranged laterally to said resting table when said pusher is in said second position.

4. Apparatus according to claim 1, wherein said resting table is vertically movable, said apparatus further comprises third actuation means, said third actuation means vertically move said resting table between a first level, where said resting table is substantially level to said first and second conveyor belts, and a second level, where containers upon said resting table are sealed by said heat-sealing head.

5. Apparatus according to claim 1, further comprising first synchronization means for mutually synchronizing said first and second actuation means, whereby said first actuation means act on said pusher to engage said grip portion with containers while said second actuation means act on said pusher to move said pusher from said first position to said second position, and whereby said first actuation means act on said pusher to disengage said grip portion while said second actuation means act on said pusher to move said pusher from said second position to said first position.

6. Apparatus according to claim 4, further comprising second synchronization means for mutually synchronizing said second and third actuation means, whereby said second actuation means act on said pusher to move said pusher from said first position to said second position while said resting table is at said first level, and whereby said second actuation means act on said pusher to move said pusher from said second position to said first position while said third actuation means act on said resting table to vertically move said resting table from said first level to said second level and from said second level back to said first level.

7. Apparatus according to claim 1, said actuation shaft has a terminal sleeve, said terminal sleeve being fixed to said second end of said actuation shaft, said terminal sleeve being internally provided with a longitudinal groove, said first actuation means comprising;

a torsion shaft, said torsion shaft being rotatably supported by said framework, said torsion shaft being arranged coaxially to said actuation shaft, a torsion free end being defined by said torsion shaft, a torsion inserted end being defined by said torsion shaft, said torsion inserted end of said torsion shaft being provided with a longitudinal protrusion, said longitudinal groove of said terminal sleeve being engageable with said longitudinal protrusion of said torsion inserted end of said torsion shaft, a crank, a first crank end being defined by said crank, a second crank end being defined by said crank, said first crank end being keyed to said torsion free end of said torsion shaft, a tension element, a first tension element end being defined by said tension element, a second tension element end being defined by said tension element, said first tension element end of said tension element being connected to said second crank end of said crank, an L-shaped lever, a first lever end being defined by said L-shaped lever, a middle lever portion being defined by said L-shaped lever, a second lever end being defined by said L-shaped lever, said first lever end of said L-shaped lever being connected to said second tension element end of said tension element, said middle lever portion of said L-shaped lever being rotatably pivoted to said framework, a first follower roller, said first follower roller being rotatably pivoted to said second lever end of said L-shaped lever, first guiding means, said first guiding means comprising a first wheel and a first circular groove cam path, said first wheel being rotatably mounted on said framework, said first circular groove cam path being provided in said first wheel, said first follower roller being slidably guided in said first circular groove cam path, a first motor reducer assembly, said first motor reducer assembly being supported by said framework, said first wheel being driven by said first motor reducer assembly.

8. Apparatus according to claim 1, wherein said actuation shaft is hollow, said actuation shaft has a terminal sleeve, said terminal sleeve being fixed to said second end of said actuation shaft, said terminal sleeve being internally provided with a longitudinal groove, said first actuation means comprising;

a torsion shaft, said torsion shaft being rotatably supported by said framework, said torsion shaft being arranged coaxially to said actuation shaft, a torsion free end being defined by said torsion shaft, a torsion inserted end being defined by said torsion shaft, said torsion inserted end of said torsion shaft being provided with a longitudinal protrusion, said longitudinal groove of said terminal sleeve being engageable with said longitudinal protrusion of said torsion inserted end of said torsion shaft, said terminal sleeve and said actuation shaft connected therefrom being longitudinally slidable on said torsion inserted end of said torsion shaft, said second actuation means comprising;

a pusher bush, said pusher bush being supported by said terminal sleeve, said pusher bush being free to rotate about said terminal sleeve, said pusher bush being longitudinally locked on said terminal sleeve in a direction parallel to said actuation shaft, a pivot, said pivot being fixed to said pusher bush, an articulated rod, a first articulated rod end being defined by said articulated rod, a second articulated rod end being defined by said articulated rod, said first articulated rod end being fixed to said pivot, an articulated quadrilateral, said articulated quadrilateral being supported by said framework, said articulated quadrilateral comprising a first lever, a second lever and a third lever, a first first lever end being defined by said first lever, a second first lever end being defined by said first lever, a first second lever end being defined by said second lever, a second second lever end being defined by said second lever, a first third lever end being defined by said third lever, a second third lever end being defined by said third lever, said first first lever end being pivoted to said second articulated rod end, said second first lever end being pivoted to said framework, said second second lever end being pivoted to said framework, said first third lever end being pivoted to said first lever at a point between said first first lever end and said second first lever end, said second third lever end being pivoted to said first second lever end, a second follower roller, said second follower roller being pivoted to said second lever at a point between said first second lever end and said second second lever end, second guiding means, said second guiding means comprising a second wheel and a second circular groove cam path, said second wheel being rotatably mounted on said framework, said second circular groove cam path being provided in said second wheel, said second follower roller being slidably guided in said second circular groove cam path, a second motor reducer assembly, said second motor reducer assembly being supported by said framework, said second wheel being driven by said second motor reducer assembly.

9. Apparatus according to claim 4, further comprising a slider, said resting table being mounted on said slider, said slider comprising;

a plurality of columns, said columns being connected to said resting table below said resting table, a plurality of supports, said supports being rigidly associated with said framework, each one of said plurality of columns being vertically slidable inside one of said supports, a plate, each one of said columns being downwardly connected to said plate, wherein said third actuation means comprise;

a pneumatic piston, a first piston end being defined by said pneumatic piston, a second piston end being defined by said pneumatic piston, said first piston end being connected to said plate of said slider, adjustment means associated with said pneumatic piston for adjusting welding pressure for sealing lamina, said adjustment means comprising screws and internal threads, a third L-shaped lever, a first lever arm being defined by said third L-shaped lever, a second lever arm being defined by said third L-shaped lever, said third L-shaped lever being pivoted to said framework, said first lever arm being pivoted to said second piston end, a third follower roller, said third follower roller being pivoted to said second lever arm, third guiding means, said third guiding means comprising a third wheel and a third circular groove cam path, said third wheel being rotatably mounted on said framework, said third circular groove cam path being provided in said third wheel, said third follower roller being slidably guided in said third circular groove cam path, a third motor reducer assembly, said third motor reducer assembly being supported by said framework, said third wheel being driven by said third motor reducer assembly.

10. Apparatus according to claim 1, wherein said pusher comprises a first pusher element and a second pusher element, said first pusher element being identical to said second pusher element, said first pusher element being arranged opposite to said second pusher element with respect to said resting table and to said first and second conveyor belts.

11. Apparatus according to claim 1, wherein said first conveyor belt operates intermittently, said first conveyor belt being stopped when said pusher is in said first position.

12. Automatic apparatus for closing containers with a sealing lamina, comprising:

a framework, a sealing unit supported by said framework, said sealing unit comprising a heat-welding head and a resting table for containers, said heat-welding head being arranged above said resting table, said sealing unit having an inlet end and an outlet end, a first conveyor belt for feeding containers to be closed, said first conveyor belt being supported by said framework and being operatively connected to said inlet end of said sealing unit, a second conveyor belt for removing closed containers, said second conveyor belt being supported by said framework and being operatively connected to said outlet end of said sealing unit, a conveyor line along which containers travel, said conveyor line being defined by said first conveyor belt, said sealing unit and said second conveyor belt, wherein said apparatus further comprises a pusher for moving a plurality of containers along said conveyor line from said first conveyor belt to said sealing unit and from said sealing unit to said second conveyor belt, said pusher being supported by said framework and being arranged laterally to said conveyor line, a grip portion being defined by said pusher, said grip portion being adapted to grip containers to be moved, said apparatus further comprising first actuation means and second actuation means, said first actuation means acting on said pusher to engage said grip portion with containers and to disengage said grip portion from containers, said second actuation means acting on said pusher to move said pusher between a first position, in which said pusher is arranged laterally to said conveyor line at said inlet end where said first conveyor belt is operatively connected to said sealing unit, and a second position, in which said pusher is arranged laterally to said conveyor line at said outlet end where said second conveyor belt is operatively connected to said sealing unit, wherein said resting table is vertically movable, said apparatus further comprises third actuation means, said third actuation means vertically move said resting table between a first level, where said resting table is substantially level to said first and second conveyor belts, and a second level, where containers upon said resting table are sealed by said heat-sealing head, said apparatus further comprising a slider, said resting table being mounted on said slider, said slider comprising;

a plurality of columns, said columns being connected to said resting table below said resting table, a plurality of supports, said supports being rigidly associated with said framework, each one of said plurality of columns being vertically slidable inside one of said supports, a plate, each one of said columns being downwardly connected to said plate, wherein said third actuation means comprise;

a pneumatic piston, a first piston end being defined by said pneumatic piston, a second piston end being defined by said pneumatic piston, said first piston end being connected to said plate of said slider, adjustment means associated with said pneumatic piston for adjusting welding pressure for sealing lamina, said adjustment means comprising screws and internal threads, a third L-shaped lever, a first lever arm being defined by said third L-shaped lever, a second lever arm being defined by said third L-shaped lever, said third L-shaped lever being pivoted to said framework, said first lever arm being pivoted to said second piston end, a third follower roller, said third follower roller being pivoted to said second lever arm, third guiding means, said third guiding means comprising a third wheel and a third circular groove cam path, said third wheel being rotatably mounted on said framework, said third circular groove cam path being provided in said third wheel, said third follower roller being slidably guided in said third circular groove cam path, a third motor reducer assembly, said third motor reducer assembly being supported by said framework, said third wheel being driven by said third motor reducer assembly.

13. Apparatus according to claim 12, wherein said grip portion extends substantially parallel to said conveyor line, said grip portion has a useful length which is substantially twice that of said resting table, whereby when said pusher is in said first position, said first actuation means act on said pusher to engage said grip portion simultaneously with unsealed containers on said first conveyor belt and with sealed containers on said resting table of said sealing unit, said second actuation means subsequently act on said pusher to move said pusher to said second position, said first actuation means subsequently act on said pusher to disengage said grip portion from containers to simultaneously place sealed containers on said second conveyor belt and unsealed containers on said resting table of said sealing unit.

14. Apparatus according to claim 12, wherein a leading half is defined by said grip portion, a trailing half is defined by said grip portion, said leading half of said grip portion is arranged laterally to said resting table when said pusher is in said first position, said trailing half of said grip portion is arranged laterally to said resting table when said pusher is in said second position.

15. Apparatus according to claim 12, further comprising first synchronization means for mutually synchronizing said first and second actuation means, whereby said first actuation means act on said pusher to engage said grip portion with containers while said second actuation means act on said pusher to move said pusher from said first position to said second position, and whereby said first actuation means act on said pusher to disengage said grip portion while said second actuation means act on said pusher to move said pusher from said second position to said first position.

16. Apparatus according to claim 12, further comprising second synchronization means for mutually synchronizing said second and third actuation means, whereby said second actuation means act on said pusher to move said pusher from said first position to said second position while said resting table is at said first level, and whereby said second actuation means act on said pusher to move said pusher from said second position to said first position while said third actuation means act on said resting table to vertically move said resting table from said first level to said second level and from said second level back to said first level.

17. Apparatus according to claim 12, wherein said pusher comprises an intermediate connecting portion and a coupling portion, said apparatus further comprising an actuation shaft, a first end being defined by said actuation shaft, a second end being defined by said actuation shaft, said actuation shaft being rotatably and slidably supported on said framework, said actuation shaft being parallel to said conveyor line, said intermediate connecting portion being connected at one end to said grip portion and being connected at another end to said coupling portion, said coupling portion being rigidly fixed to said first end of said actuation shaft.

18. Apparatus according to claim 17, said actuation shaft has a terminal sleeve, said terminal sleeve being fixed to said second end of said actuation shaft, said terminal sleeve being internally provided with a longitudinal groove, said first actuation means comprising;

a torsion shaft, said torsion shaft being rotatably supported by said framework, said torsion shaft being arranged coaxially to said actuation shaft, a torsion free end being defined by said torsion shaft, a torsion inserted end being defined by said torsion shaft, said torsion inserted end of said torsion shaft being provided with a longitudinal protrusion, said longitudinal groove of said terminal sleeve being engageable with said longitudinal protrusion of said torsion inserted end of said torsion shaft, a crank, a first crank end being defined by said crank, a second crank end being defined by said crank, said first crank end being keyed to said torsion free end of said torsion shaft, a tension element, a first tension element end being defined by said tension element, a second tension element end being defined by said tension element, said first tension element end of said tension element being connected to said second crank end of said crank, an L-shaped lever, a first lever end being defined by said L-shaped lever, a middle lever portion being defined by said L-shaped lever, a second lever end being defined by said L-shaped lever, said first lever end of said L-shaped lever being connected to said second tension element end of said tension element, said middle lever portion of said L-shaped lever being rotatably pivoted to said framework, a first follower roller, said first follower roller being rotatably pivoted to said second lever end of said L-shaped lever, first guiding means, said first guiding means comprising a first wheel and a first circular groove cam path, said first wheel being rotatably mounted on said framework, said first circular groove cam path being provided in said first wheel, said first follower roller being slidably guided in said first circular groove cam path, a first motor reducer assembly, said first motor reducer assembly being supported by said framework, said first wheel being driven by said first motor reducer assembly.

19. Apparatus according to claim 17, wherein said actuation shaft is hollow, said actuation shaft has a terminal sleeve, said terminal sleeve being fixed to said second end of said actuation shaft, said terminal sleeve being internally provided with a longitudinal groove, said first actuation means comprising;

a torsion shaft, said torsion shaft being rotatably supported by said framework, said torsion shaft being arranged coaxially to said actuation shaft, a torsion free end being defined by said torsion shaft, a torsion inserted end being defined by said torsion shaft, said torsion inserted end of said torsion shaft being provided with a longitudinal protrusion, said longitudinal groove of said terminal sleeve being engageable with said longitudinal protrusion of said torsion inserted end of said torsion shaft, said terminal sleeve and said actuation shaft connected therefrom being longitudinally slidable on said torsion inserted end of said torsion shaft, said second actuation means comprising;

a pusher bush, said pusher bush being supported by said terminal sleeve, said pusher bush being free to rotate about said terminal sleeve, said pusher bush being longitudinally locked on said terminal sleeve in a direction parallel to said actuation shaft, a pivot, said pivot being fixed to said pusher bush, an articulated rod, a first articulated rod end being defined by said articulated rod, a second articulated rod end being defined by said articulated rod, said first articulated rod end being fixed to said pivot, an articulated quadrilateral, said articulated quadrilateral being supported by said framework, said articulated quadrilateral comprising a first lever, a second lever and a third lever, a first first lever end being defined by said first lever, a second first lever end being defined by said first lever, a first second lever end being defined by said second lever, a second second lever end being defined by said second lever, a first third lever end being defined by said third lever, a second third lever end being defined by said third lever, said first first lever end being pivoted to said second articulated rod end, said second first lever end being pivoted to said framework, said second second lever end being pivoted to said framework, said first third lever end being pivoted to said first lever at a point between said first first lever end and said second first lever end, said second third lever end being pivoted to said first second lever end, a second follower roller, said second follower roller being pivoted to said second lever at a point between said first second lever end and said second second lever end, second guiding means, said second guiding means comprising a second wheel and a second circular groove cam path, said second wheel being rotatably mounted on said framework, said second circular groove cam path being provided in said second wheel, said second follower roller being slidably guided in said second circular groove cam path, a second motor reducer assembly, said second motor reducer asembly being supported by said framework, said second wheel being driven by said second motor reducer assembly.

20. Apparatus according to claim 12, wherein said pusher comprises a first pusher element and a second pusher element, said first pusher element being identical to said second pusher element, said first pusher element being arranged opposite to said second pusher element with respect to said resting table and to said first and second conveyor belts.

21. Apparatus according to claim 12, wherein said first conveyor belt operates intermittently, said first conveyor belt being stopped when said pusher is in said first position.

* * * * *